US008653738B2

(12) United States Patent
He et al.

(10) Patent No.: US 8,653,738 B2
(45) Date of Patent: Feb. 18, 2014

(54) BACKLIGHT MODULE

(75) Inventors: Chengming He, Shenzhen (CN); Chingyuan Yang, Shenzhen (CN)

(73) Assignee: Shenzhen China Star Optoelectronics Technology Co. Ltd., Shenzhen (CN)

( * ) Notice: Subject to any disclaimer, the term of this patent is extended or adjusted under 35 U.S.C. 154(b) by 575 days.

(21) Appl. No.: 12/995,730

(22) PCT Filed: Sep. 1, 2010

(86) PCT No.: PCT/CN2010/076533
§ 371 (c)(1), (2), (4) Date: Dec. 2, 2010

(87) PCT Pub. No.: WO2012/012954
PCT Pub. Date: Feb. 2, 2012

(65) Prior Publication Data
US 2012/0025721 A1 Feb. 2, 2012

(30) Foreign Application Priority Data
Jul. 30, 2010 (CN) ..... 2010 1 0245678

(51) Int. Cl.
*H05B 37/00* (2006.01)

(52) U.S. Cl.
USPC ..... 315/192; 315/185 R; 315/312

(58) Field of Classification Search
USPC ..... 315/185 R, 192, 185 S, 291, 294, 297, 315/312
See application file for complete search history.

(56) References Cited

U.S. PATENT DOCUMENTS

| | | | | |
|---|---|---|---|---|
| 2007/0013620 | A1 | 1/2007 | Tanahashi et al. | |
| 2008/0100561 | A1 | 5/2008 | Price et al. | |
| 2010/0177127 | A1 | 7/2010 | Akiyama et al. | |
| 2011/0062872 | A1 * | 3/2011 | Jin et al. ..... | 315/122 |

FOREIGN PATENT DOCUMENTS

| | | | |
|---|---|---|---|
| CN | 1617644 | A | 5/2005 |
| CN | 101640029 | A | 2/2010 |

* cited by examiner

*Primary Examiner* — Douglas W Owens
*Assistant Examiner* — Jianzi Chen
(74) *Attorney, Agent, or Firm* — Ditthavong Mori & Steiner, P.C.

(57) ABSTRACT

The present invention provides a backlight module, and the backlight module has an LED module which has a plurality of light emitting diodes averagely divided into a plurality of light strings. Forward voltages of the light emitting diodes are between a minimum forward-voltage value and a maximum forward-voltage value, and each of the light strings at least has one first light emitting diode and one second light emitting diode. The first light emitting diode has the minimum forward-voltage value and the second light emitting diode has the maximum forward-voltage value. The backlight module is contributive to lower power loss on a constant current control circuit.

20 Claims, 2 Drawing Sheets

BACKLIGHT MODULE

FIELD OF THE INVENTION

The present invention relates to a backlight module, and more particularly to a backlight module that efficiently reduce power loss in internal constant current control circuit.

BACKGROUND OF THE INVENTION

A light-emitting diode (LED) has advantages of power-saving, long lifetime and small size, so that using light emitting diodes as a backlight source is already the current trend of the technological development of liquid crystal display (LCD). However, the light emitting diodes still have many application problems needed to be overcome.

Means for applying light emitting diodes to backlight module are generally sorted into edge-type and direct-type. With reference to FIG. 1, FIG. 1 discloses a conventional arrangement of light emitting diodes for a direct-type backlight module, wherein a plurality of light strings 90 are arranged side by side on a back of a liquid crystal panel as a light source of a backlight module, wherein the light strings 90 include a first light string 901, a second light string 902 and a third light string 903. Each of the light strings 90 is formed with a plurality of light emitting diodes 900 connected in series. One end of the light strings 90 are connected to a DC/DC converter 91 and the other end thereof are connected to a constant current control circuit. The DC/DC converter 91 converts a DC power source into proper voltage level for the light string 90 to use. The constant current control circuit 92 controls the operating current of each of the light strings through a voltage feedback to keep the operating current stable to prevent the light emitting diodes 900 from flickering.

However, the constant current control circuit 92 usually has different power loss on each of the light strings 90. This is because cost of classifying the light emitting diodes 900 according to device characteristic is too high, testing and classification on the forward voltage of each of the light emitting diodes 900 are generally not performed when arranging the light emitting diodes 900. With reference to FIG. 1, it shows that forward voltages VF of the light emitting diodes 900 of the first light string 901 are ranged from 3.1 volts to 3.5 volts; forward voltages VF of the light emitting diodes 900 of the second light string 902 are ranged from 3.1 volts to 3.4 volts; forward voltage VF of the light emitting diodes 900 of the third light string 903 are all 3.1 volts. Because one of the light emitting diodes 900 has a highest forward voltage VF of 3.5 volts, the DC/DC converter 91 must use this voltage value as a standard to drive all of the light emitting diodes 900, so that other light emitting diodes 900 having forward voltage less that 3.5 volts would have redundant power loss. Take the third light string 903 matching the least requirements as an example, the forward voltages VF of the light emitting diodes 900 thereof are all 3.1 volts, the lowest in forward voltage, wherein if the third light string 903 has five of said light emitting diodes 900 and the constant current is 120 mA, the third light string will have power loss reaching up to $5\times(3.5-3.1)\times0.12=0.24$ W (Watts).

To overcome this problem, although each of the light string 90 is available to independently use one said DC/DC converter 91, so as to be provided different driving voltages according to forward-voltage characteristic of each said light string 90, such method will highly increase the cost of using the DC/DC converters 91 and does not match practical considerations in production cost.

Hence, it is necessary to provide a backlight module to overcome the problems existing in the conventional technology.

SUMMARY OF THE INVENTION

A primary object of the invention is to provide a backlight module which comprises light strings that reduce the difference in power loss on a constant current control circuit by the arrangement of light emitting diodes and thus efficiently reduce overall power loss of the constant current control circuit.

A secondary object of the present invention is to provide a backlight module which confirms the forward voltages of the light emitting diodes of each light string are distributed in the same voltage range when averagely dividing the light emitting diodes into the light strings, so as to diminish the difference in power loss that the light strings consume on the constant current control circuit.

To achieve the above object, the present invention provides a backlight module which comprises:

an LED module having a plurality of light emitting diodes, wherein the light emitting diodes are averagely divided into a plurality of light strings, wherein the light emitting diodes of each of the light strings are connected in series and each of the light strings has a first connecting end and a second connecting end, forward voltages of the light emitting diodes are between a minimum forward-voltage value and a maximum forward-voltage value and each of the light strings at least has one first light emitting diode and one second light emitting diode, wherein the first light emitting diode has the minimum forward-voltage value, the second light emitting diode has the maximum forward-voltage value;

a DC/DC converter connected to the first connecting ends of the light strings; and a constant current control circuit connected to the second connecting ends of the light strings.

In one embodiment of the present invention, the forward voltages of the light emitting diodes of each of the light strings increase progressively from the minimum forward-voltage value to the maximum forward-voltage value in turn.

In one embodiment of the present invention, average forward-voltages of the light emitting diodes of each of the light strings are equal.

In one embodiment of the present invention, the light emitting diodes are arranged on a plane to form a light emitting surface of the backlight module.

In one embodiment of the present invention, the backlight module is a direct-type backlight module.

Furthermore, to achieve another above object, the present invention provides a backlight module which comprises an LED module, wherein the LED module has a plurality of light emitting diodes are averagely divided into a plurality of light strings, wherein the light emitting diodes of each of the light strings are connected in series, wherein forward voltages of the light emitting diodes are between a minimum forward-voltage value and a maximum forward-voltage value and each of the light strings at least has one first light emitting diode and one second light emitting diode, wherein the first light emitting diode has the minimum forward-voltage value, the second light emitting diode has the maximum forward-voltage value.

In one embodiment of the present invention, the forward voltages of the light emitting diodes of each of the light strings increase progressively from the minimum forward-voltage value to the maximum forward-voltage value in turn.

In one embodiment of the present invention, average forward-voltages of the light emitting diodes of each of the light strings are equal.

In one embodiment of the present invention, the light emitting diodes are arranged on a plane to form a light emitting surface of the backlight module.

In one embodiment of the present invention, the backlight module is a direct-type backlight module.

In one embodiment of the present invention, the light strings are connected between a DC/DC converter and a constant current control circuit.

DETAILED DESCRIPTION OF THE PREFERRED EMBODIMENTS

The foregoing objects, features and advantages adopted by the present invention can be best understood by referring to the following detailed description of the preferred embodiments and the accompanying drawings.

Figure 1:
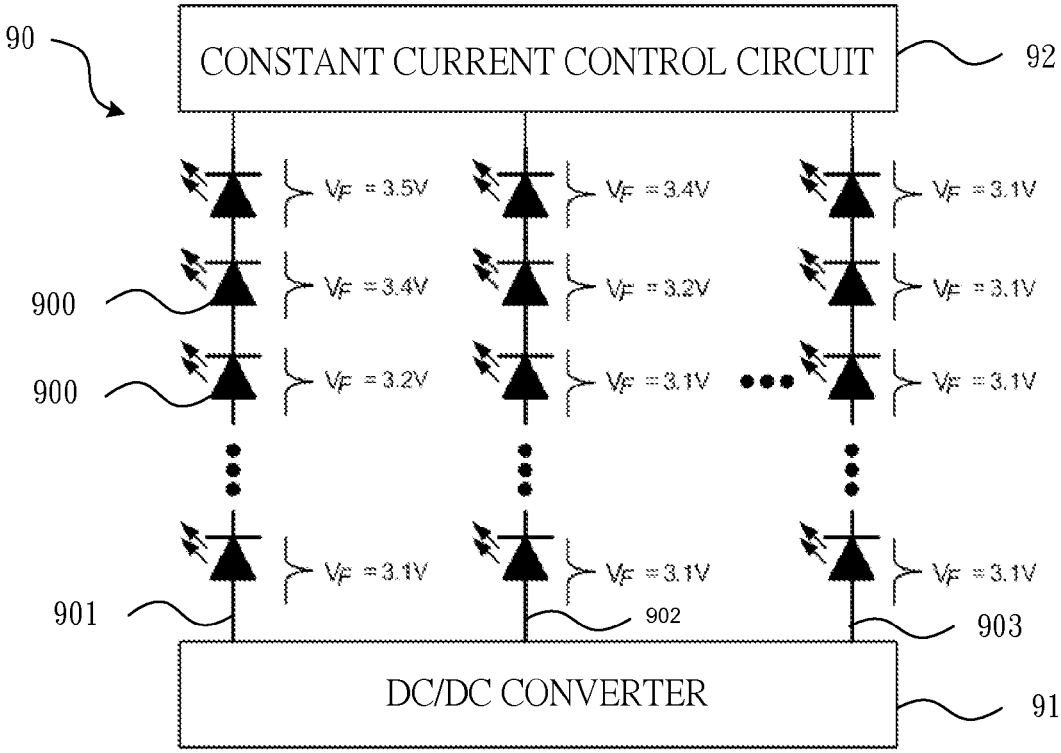
FIG. 1 is a schematic view of arrangement of light emitting diodes of a conventional backlight module.
Figure 2:
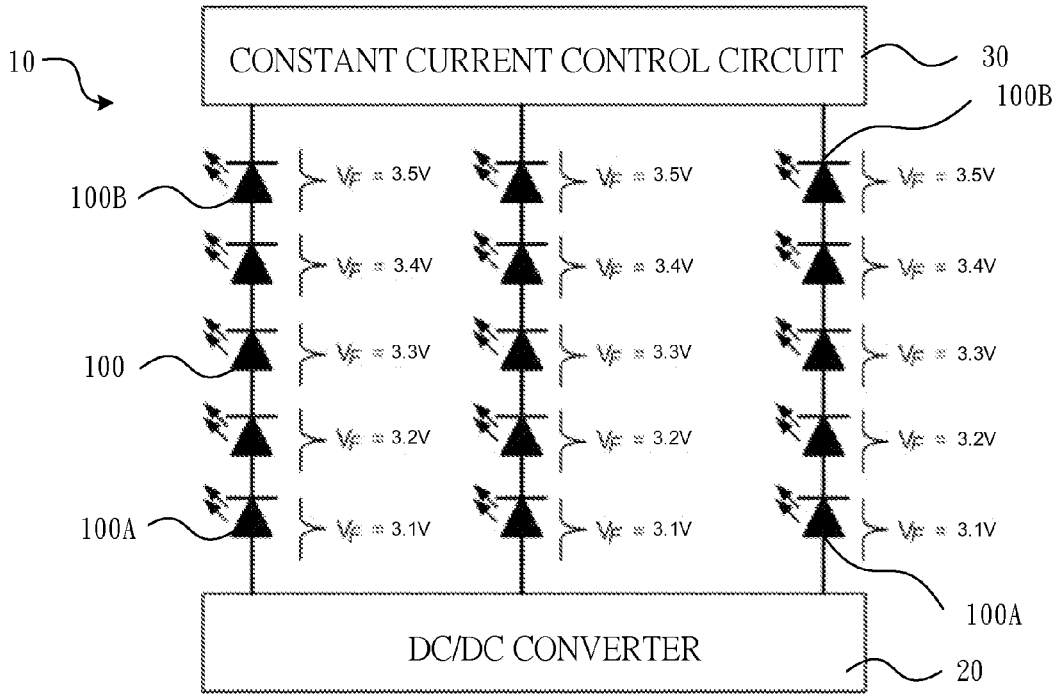
FIG. 2 is a schematic view of arrangement of light emitting diodes of a backlight module according to a preferred embodiment of the present invention.

With reference to FIG. 2, FIG. 2 discloses a schematic view of arrangement of light emitting diodes of a backlight module according to a preferred embodiment of the present invention, wherein the backlight module comprises an LED module, a DC/DC converter 20 and a constant current control circuit 30.

The LED module has a plurality of light emitting diodes 100, the light emitting diodes are arranged on a plane to form a light emitting surface, hence the present may be a direct-type backlight module. The light emitting diodes 100 are averagely divided into a plurality of light strings 10, wherein the light emitting diodes 100 of each of the light strings 10 are connected in series, and each of the light strings 10 has a first connecting end and a second connecting end. Forward voltages of the light emitting diodes 100 are between a minimum forward-voltage value and a maximum forward-voltage value, wherein each light string 10 at least has one first light emitting diode 100A and one second light emitting diode 100B, wherein the first light emitting diode 100A has the minimum forward-voltage value, the second light emitting diode 100B has the maximum forward-voltage value. Preferably, the forward voltages of the light emitting diodes 100 of each of the light strings 10 increase progressively from the minimum forward-voltage value to the maximum forward-voltage value in turn, and average forward-voltages of the light emitting diodes 100 of each of the light strings 10 are equal.

For this embodiment, with reference to FIG. 2, each of the light string 10 comprises five of said light emitting diodes 100 connected in series, wherein the first light emitting diode 100A and the second light emitting diode 100B of each of the light string 10 has a minimum forward-voltage value of 3.1V and a maximum forward-voltage value of 3.5V, respectively; and the forward voltages of the light emitting diodes 100 increase progressively to be 3.1V, 3.2V, 3.3V, 3.4V and 3.5V in turn. Hence, an average of the forward voltages of the light emitting diodes 100 of each light string 10 is 3.3V.

The DC/DC converter 20 is connected to the first connecting ends of the light strings 10 to convert a DC power to a proper dc-voltage-level for each of the light strings 10 to use.

The constant current control circuit 30 is connected to the second connecting ends of the light strings 10 to control current flowing through each of the light strings 10 to maintain said current constant.

The LED module of the backlight module of the present invention mainly comprises a plurality of light emitting diodes 100 which are averagely divided into a plurality light string 10, wherein forward voltages of the light emitting diodes 100 of each of the light string 10 are between a maximum forward-voltage value and a minimum forward-voltage value, so as to diminish the difference of power loss that each of the light strings 10 consumes on the constant current control circuit 30.

For the embodiment shown in FIG. 2, the current flowing through the light strings 10 is 120 mA, so that the overall power loss that each of the light strings 10 consumes on the constant current control circuit 30 is:

$$\{(3.5-3.5)+(3.5-3.4)+(3.5-3.3)+(3.5-3.2)+(3.5-3.1)\}\times 0.12=0.12\text{ W}$$

As mentioned above, with the same current condition, compared with the power loss of 0.24 W that foregoing conventional backlight module may consume, the preferred embodiment of the present invention in FIG. 2 makes an arrangement that each of the light string 10 has an equal average on forward-voltage value of the light emitting diodes 100 thereof, so as to efficiently reduce the power loss on the constant current control circuit 30 to 0.12 W, which reduce half the power loss, to further be contributive to improve conversion efficiency of circuit, which means the input power of working power source can be lowered and has energy-saving effect. Hence, the backlight module of the present invention indeed can efficiently improve shortcomings of the conventional technique.

The present invention has been described with a preferred embodiment thereof and it is understood that many changes and modifications to the described embodiment can be carried out without departing from the scope and the spirit of the invention that is intended to be limited only by the appended claims.

The invention claimed is:

1. A backlight module comprising:

an LED module having a plurality of light emitting diodes, wherein the light emitting diodes are averagely divided into a plurality of light strings, wherein the light emitting diodes of each of the light strings are connected in series and each of the light strings has a first connecting end and a second connecting end, each of the light emitting diodes has a forward voltage, wherein the forward voltage of each of the light emitting diodes is ranged between a minimum forward voltage value and a maximum forward voltage value, and each of the light strings at least has one first light emitting diode and one second light emitting diode, wherein the first light emitting diode has the minimum forward-voltage value, the second light emitting diode has the maximum forward-voltage value and the forward voltages of the light emitting diodes of each of the light string increase progressively from the minimum forward-voltage value to the maximum forward-voltage value in turn, and the average of the forward voltage values of the light emitting diodes of each of the light strings is the same as the average of the forward voltage values of the light emitting diodes of other one of the light strings;

a DC/DC converter connected to the first connecting ends of the light strings; and a constant current control circuit connected to the second connecting ends of the light strings.

2. A backlight module comprising:

an LED module having a plurality of light emitting diodes, wherein the light emitting diodes are averagely divided into a plurality of light strings, wherein the light emitting diodes of each of the light strings are connected in series and each of the light strings has a first connecting end and a second connecting end, each of the light emitting diodes has a forward voltage, wherein the forward voltage of each of the light emitting diodes is ranged between a minimum forward voltage value and a maximum forward voltage value, and each of the light strings at least has one first light emitting diode and one second light emitting diode, wherein the first light emitting diode has the minimum forward-voltage value, the second light emitting diode has the maximum forward-voltage value;

a DC/DC converter connected to the first connecting ends of the light strings; and a constant current control circuit connected to the second connecting ends of the light strings.

3. The backlight module as claimed in claim 2, wherein the forward voltages of the light emitting diodes of each of the light strings increase progressively from the minimum forward-voltage value to the maximum forward-voltage value in turn.

4. The backlight module as claimed in claim 3, wherein the light emitting diodes are arranged on a plane to form a light emitting surface of the backlight module.

5. The backlight module as claimed in claim 2, wherein the average of the forward voltage values of the light emitting diodes of each of the light strings is the same as the average of the forward voltage values of the light emitting diodes of other one of the light strings.

6. The backlight module as claimed in claim 5, wherein the light emitting diodes are arranged on a plane to form a light emitting surface of the backlight module.

7. The backlight module as claimed in claim 2, wherein the light emitting diodes are arranged on a plane to form a light emitting surface of the backlight module.

8. The backlight module as claimed in claim 7, wherein the backlight module is a direct-type backlight module.

9. A backlight module comprising:

an LED module, wherein the LED module has a plurality of light emitting diodes are averagely divided into a plurality of light strings, wherein the light emitting diodes of each of the light strings are connected in series, wherein each of the light emitting diodes has a forward voltage, wherein the forward voltage of each of the light emitting diodes is ranged between a minimum forward voltage value and a maximum forward voltage value, and each of the light strings at least has one first light emitting diode and one second light emitting diode, wherein the first light emitting diode has the minimum forward-voltage value, the second light emitting diode has the maximum forward-voltage value.

10. The backlight module as claimed in claim 9, wherein the forward voltages of the light emitting diodes of each of the light strings increase progressively from the minimum forward-voltage value to the maximum forward-voltage value in turn.

11. The backlight module as claimed in claim 10, characterized in that: average forward-voltages of the light emitting diodes of each of the light strings are equal.

12. The backlight module as claimed in claim 11, wherein the light emitting diodes are arranged on a plane to form a light emitting surface of the backlight module.

13. The backlight module as claimed in claim 11, wherein the light strings are connected between a DC/DC converter and a constant current control circuit.

14. The backlight module as claimed in claim 10, wherein the light emitting diodes are arranged on a plane to form a light emitting surface of the backlight module.

15. The backlight module as claimed in claim 10, wherein the light strings are connected between a DC/DC converter and a constant current control circuit.

16. The backlight module as claimed in claim 9, wherein the average of the forward voltage values of the light emitting diodes of each of the light strings is the same as the average of the forward voltage values of the light emitting diodes of other one of the light strings.

17. The backlight module as claimed in claim 16, wherein the light emitting diodes are arranged on a plane to form a light emitting surface of the backlight module.

18. The backlight module as claimed in claim 16, wherein the light strings are connected between a DC/DC converter and a constant current control circuit.

19. The backlight module as claimed in claim 9, wherein the light emitting diodes are arranged on a plane to form a light emitting surface of the backlight module.

20. The backlight module as claimed in claim 9, wherein the light strings are connected between a DC/DC converter and a constant current control circuit.

* * * * *